US007137454B2

(12) United States Patent
Pietras

(10) Patent No.: US 7,137,454 B2
(45) Date of Patent: Nov. 21, 2006

(54) APPARATUS FOR FACILITATING THE CONNECTION OF TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/129,734

(22) Filed: May 13, 2005

(65) Prior Publication Data

US 2005/0269105 A1 Dec. 8, 2005

Related U.S. Application Data

(63) Continuation of application No. 10/967,387, filed on Oct. 18, 2004, now abandoned, which is a continuation of application No. 09/509,073, filed as application No. PCT/GB99/02203 on Jul. 22, 1999, now abandoned.

(30) Foreign Application Priority Data

Jul. 22, 1998 (GB) ..... 9815809
Aug. 24, 1998 (GB) ..... 9818358

(51) Int. Cl.
*E21B 31/20* (2006.01)
*E21B 19/18* (2006.01)
*B66C 1/42* (2006.01)

(52) U.S. Cl. ..... 166/380; 166/75.14; 166/77.52; 166/98; 166/383; 294/86.4; 294/93

(58) Field of Classification Search ..... 166/98, 166/77.4, 77.52, 85.5, 75.14, 379, 380, 382, 166/383, 385; 294/86.24, 86.25, 86.15, 93, 294/94, 96

See application file for complete search history.

(56) References Cited

U.S. PATENT DOCUMENTS 122,514 A 1/1872 Bullock (Continued)

FOREIGN PATENT DOCUMENTS

CA 2 335 192 11/2001

(Continued)

OTHER PUBLICATIONS

LaFleur Petroleum Services, Inc., "Autoseal Circulating Head," Engineering Manufacturing, 1992, 11 pages.

(Continued)

*Primary Examiner*—Jennifer H. Gay
(74) *Attorney, Agent, or Firm*—Patterson & Sheridan, L.L.P.

(57) ABSTRACT

A method and apparatus for facilitating the connection of tubulars using a top drive which, in one aspect, the apparatus includes a body connectable to said top drive. The body includes at least one gripping element radially displaceable by hydraulic or pneumatic fluid to drivingly engage a tubular to permit a screw connection between said tubular and a further tubular to be tightened to the required torque.

32 Claims, 4 Drawing Sheets

U.S. PATENT DOCUMENTS

| | | | |
|---|---|---|---|
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,167,338 | A | 7/1939 | Murcell |
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,720,267 | A | 10/1955 | Brown |
| 2,738,011 | A | 3/1956 | Mabry |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,953,406 | A | 9/1960 | Young |
| 2,978,047 | A | 4/1961 | DeVaan |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,624,760 | A | 11/1971 | Bodine |
| 3,635,105 | A | 1/1972 | Dickmann et al. |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,729,057 | A | 4/1973 | Werner |
| 3,746,330 | A | 7/1973 | Taciuk |
| 3,747,675 | A | 7/1973 | Brown |
| 3,760,894 | A | 9/1973 | Pitifer |
| 3,766,991 | A | 10/1973 | Brown |
| 3,776,320 | A | 12/1973 | Brown |
| 3,776,991 | A | 12/1973 | Marcus |
| 3,785,193 | A | 1/1974 | Kinley et al. |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,870,114 | A | 3/1975 | Pulk deceased et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown, deceased |
| 3,934,660 | A | 1/1976 | Nelson |
| 3,945,444 | A | 3/1976 | Knudson |
| 3,947,009 | A | 3/1976 | Nelmark |
| 3,964,556 | A | 6/1976 | Gearhart et al. |
| 3,980,143 | A | 9/1976 | Swartz et al. |
| 4,049,066 | A | 9/1977 | Richey |
| 4,054,332 | A | 10/1977 | Bryan, Jr. |
| 4,054,426 | A | 10/1977 | White |
| 4,064,939 | A | 12/1977 | Marquis |
| 4,077,525 | A | 3/1978 | Callegari et al. |
| 4,082,144 | A | 4/1978 | Marquis |
| 4,083,405 | A | 4/1978 | Shirley |
| 4,085,808 | A | 4/1978 | Kling |
| 4,095,865 | A | 6/1978 | Denison et al. |
| 4,100,968 | A | 7/1978 | Delano |
| 4,100,981 | A | 7/1978 | Chaffin |
| 4,127,927 | A | 12/1978 | Hauk et al. |
| 4,133,396 | A | 1/1979 | Tschirky |
| 4,142,739 | A | 3/1979 | Billingsley |
| 4,173,457 | A | 11/1979 | Smith |
| 4,175,619 | A | 11/1979 | Davis |
| 4,186,628 | A | 2/1980 | Bonnice |
| 4,189,185 | A | 2/1980 | Kammerer, Jr. et al. |

4,194,383 A 3/1980 Huzyak
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindesy, Jr.
4,311,195 A 1/1982 Mullins, II
4,315,553 A 2/1982 Stallings
4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A 7/1991 Wilson
5,036,927 A * 8/1991 Willis ..... 175/162
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.

5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
2,741,907 A 6/1997 Genender et al.
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,815,546 A 9/1998 Flohr et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.

5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,552 B1 4/2002 Scott et al.
6,367,566 B1 4/2002 Hill
6,371,203 B1 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B1 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 * 8/2002 Bouligny ..... 294/86.25
6,443,241 B1 9/2002 Juhasz et al.
6,443,247 B1 9/2002 Wardley
6,446,723 B1 9/2002 Ramos et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B1 3/2003 Birckhead et al.
6,536,993 B1 3/2003 Strong et al.
6,538,576 B1 3/2003 Schultz et al.
6,540,025 B1 4/2003 Scott et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,585,040 B1 7/2003 Hanton et al.
6,591,471 B1 7/2003 Hollingsworth et al.
6,595,288 B1 7/2003 Mosing et al.
6,619,402 B1 9/2003 Amory et al.
6,622,796 B1 9/2003 Pietras
6,634,430 B1 10/2003 Dawson et al.
6,637,526 B1 10/2003 Juhasz et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,679,333 B1 1/2004 York et al.
6,688,394 B1 2/2004 Ayling
6,688,398 B1 2/2004 Pietras
6,691,801 B1 2/2004 Juhasz et al.
6,698,595 B1 3/2004 Norell et al.
6,702,040 B1 3/2004 Sensenig
6,708,769 B1 3/2004 Haugen et al.
6,715,430 B1 4/2004 Choi et al.
6,719,071 B1 4/2004 Moyes
6,725,924 B1 4/2004 Davidson et al.
6,725,938 B1 4/2004 Pietras
6,732,822 B1 5/2004 Slack et al.
6,742,584 B1 6/2004 Appleton
6,742,596 B1 6/2004 Haugen
6,742,606 B1 6/2004 Metcalfe et al.
6,745,834 B1 6/2004 Davis et al.
6,752,211 B1 6/2004 Dewey et al.
6,776,233 B1 8/2004 Meehan
6,832,656 B1 12/2004 Fournier, Jr. et al.
6,832,658 B1 12/2004 Keast
6,837,313 B1 1/2005 Hosie et al.
6,840,322 B1 1/2005 Haynes
6,848,517 B1 2/2005 Wardley
6,854,533 B1 2/2005 Galloway et al.
6,857,486 B1 2/2005 Galloway et al.
6,857,487 B1 2/2005 Brunnert et al.
6,868,906 B1 3/2005 Vail, III et al.
6,877,553 B1 4/2005 Cameron
6,892,835 B1 5/2005 Shahin et al.
6,896,075 B1 5/2005 Haugen et al.
6,899,186 B1 5/2005 Galloway et al.

| | | | |
|---|---|---|---|
| 6,899,772 | B1 | 5/2005 | Morando |
| 2001/0042625 | A1 | 11/2001 | Appleton |
| 2002/0040787 | A1 | 4/2002 | Cook et al. |
| 2002/0066556 | A1 | 6/2002 | Goode et al. |
| 2002/0108748 | A1 | 8/2002 | Keyes |
| 2002/0134555 | A1 | 9/2002 | Allen et al. |
| 2002/0170720 | A1 | 11/2002 | Haugen |
| 2002/0189863 | A1 | 12/2002 | Wardley |
| 2003/0029641 | A1 | 2/2003 | Meehan |
| 2003/0056991 | A1 | 3/2003 | Hahn et al. |
| 2003/0070841 | A1 | 4/2003 | Merecka et al. |
| 2003/0111267 | A1 | 6/2003 | Pia |
| 2003/0141111 | A1 | 7/2003 | Pia |
| 2003/0146023 | A1 | 8/2003 | Pia |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0217865 | A1 | 11/2003 | Simpson et al. |
| 2003/0221519 | A1 | 12/2003 | Haugen et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0060697 | A1 | 4/2004 | Tilton et al. |
| 2004/0069500 | A1 | 4/2004 | Haugen |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaite et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalle et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0096846 | A1 | 5/2005 | Koithan et al. |

FOREIGN PATENT DOCUMENTS

| | | | |
|---|---|---|---|
| DE | 3 213 464 | | 10/1983 |
| DE | 3 523 221 | | 2/1987 |
| DE | 3 918 132 | | 12/1989 |
| DE | 4 133 802 | | 10/1992 |
| EP | 0 087 373 | | 8/1983 |
| EP | 0 171 144 | | 2/1985 |
| EP | 0 162 000 | A1 | 11/1985 |
| EP | 0 171 144 | A1 | 2/1986 |
| EP | 0 235 105 | | 9/1987 |
| EP | 0 265 344 | | 4/1988 |
| EP | 0 285 386 | A2 | 10/1988 |
| EP | 0 426 123 | | 5/1991 |
| EP | 0 525 247 | A1 | 8/1991 |
| EP | 0 474 481 | | 3/1992 |
| EP | 0 589 823 | A1 | 3/1994 |
| EP | 0 659 975 | A2 | 6/1995 |
| EP | 0 790 386 | | 8/1997 |
| EP | 0 881 354 | | 4/1998 |
| EP | 0 962 384 | | 12/1999 |
| EP | 1 006 260 | | 6/2000 |
| EP | 1 050 661 | | 11/2000 |
| EP | 1 148 206 | | 10/2001 |
| FR | 2 053 088 | | 7/1970 |
| FR | 2 741 907 | | 6/1997 |
| FR | 2 841 293 | | 12/2003 |
| GB | 540 027 | | 10/1941 |
| GB | 709 365 | | 5/1954 |
| GB | 716 761 | | 10/1954 |
| GB | 792 886 | | 4/1958 |
| GB | 838 833 | | 6/1960 |
| GB | 881 358 | | 11/1961 |
| GB | 997 721 | | 7/1965 |
| GB | 1 277 461 | | 6/1972 |
| GB | 1 306 568 | | 3/1973 |
| GB | 1 448 304 | | 9/1976 |
| GB | 1 469 661 | | 4/1977 |
| GB | 1 582 392 | | 1/1981 |
| GB | 2 053 088 | | 2/1981 |
| GB | 2 115 940 | | 9/1983 |
| GB | 2 170 528 | | 8/1986 |
| GB | 2 201 912 | | 9/1988 |
| GB | 2 216 926 | | 10/1989 |
| GB | 2 223 253 | | 4/1990 |
| GB | 2 224 481 | A | 5/1990 |
| GB | 2 240 799 | | 8/1991 |
| GB | 2 275 486 | A | 8/1994 |
| GB | 2 294 715 | | 8/1996 |
| GB | 2 313 860 | | 2/1997 |
| GB | 2 320 270 | | 6/1998 |
| GB | 2 324 108 | | 10/1998 |
| GB | 2 333 542 | | 7/1999 |
| GB | 2 335 217 | | 9/1999 |
| GB | 2 340 856 | A | 3/2000 |
| GB | 2 345 074 | | 6/2000 |
| GB | 2 347 445 | | 9/2000 |
| GB | 2 348 223 | | 9/2000 |
| GB | 2 349 401 | | 11/2000 |
| GB | 2 350 137 | | 11/2000 |
| GB | 2 357 530 | A | 6/2001 |
| GB | 2 352 747 | | 7/2001 |
| GB | 2 372 271 | | 8/2002 |
| GB | 2 372 765 | | 9/2002 |
| GB | 2 386 626 | | 9/2003 |
| GB | 2 389 130 | | 12/2003 |
| WO | WO 91-16520 | | 10/1991 |
| WO | WO 93/07358 | | 4/1993 |
| WO | WO 96-18799 | | 6/1996 |
| WO | WO 96/18799 | | 6/1996 |
| WO | WO 96-28635 | | 9/1996 |
| WO | WO 97-08418 | | 3/1997 |
| WO | WO 98/01651 | | 1/1998 |
| WO | WO 98-05844 | | 2/1998 |
| WO | WO 98/05844 | | 2/1998 |
| WO | WO 98-09053 | | 3/1998 |
| WO | WO 98/11322 | | 3/1998 |
| WO | WO 98/32948 | | 7/1998 |
| WO | WO 98-55730 | | 12/1998 |
| WO | WO 99-04135 | | 1/1999 |
| WO | WO 99-11902 | | 3/1999 |
| WO | WO 99-23354 | | 5/1999 |
| WO | WO 99-24689 | | 5/1999 |
| WO | WO 99-35368 | | 7/1999 |
| WO | WO 99-37881 | | 7/1999 |
| WO | WO 99-41485 | | 8/1999 |
| WO | WO 99-50528 | | 10/1999 |
| WO | WO 99-58810 | | 11/1999 |
| WO | WO 99-64713 | | 12/1999 |
| WO | WO 00/04269 | | 1/2000 |
| WO | WO 00-05483 | | 2/2000 |
| WO | WO 00/05483 | | 2/2000 |
| WO | WO 00-06293 | | 2/2000 |
| WO | WO 00/09853 | | 2/2000 |

| | | |
|---|---|---|
| WO | WO 00/11309 | 3/2000 |
| WO | WO 00/11310 | 3/2000 |
| WO | WO 00/11311 | 3/2000 |
| WO | WO 00-28188 | 5/2000 |
| WO | WO 00-37766 | 6/2000 |
| WO | WO 00-37771 | 6/2000 |
| WO | WO 00/39429 | 7/2000 |
| WO | WO 00-39429 | 7/2000 |
| WO | WO 00-39430 | 7/2000 |
| WO | WO 00/39430 | 7/2000 |
| WO | WO 00/41487 | 7/2000 |
| WO | WO 00-46484 | 8/2000 |
| WO | WO 00-50730 | 8/2000 |
| WO | WO 00-66879 | 11/2000 |
| WO | WO 01-12946 | 2/2001 |
| WO | WO 01-46550 | 6/2001 |
| WO | WO 01-79650 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 02/14649 | 2/2002 |
| WO | WO 02-44601 | 6/2002 |
| WO | WO 02-081863 | 10/2002 |
| WO | WO 02-086287 | 10/2002 |
| WO | WO 03/006790 | 1/2003 |
| WO | WO 03-074836 | 9/2003 |
| WO | WO 03-087525 | 10/2003 |
| WO | WO 2004/022903 | 3/2004 |

OTHER PUBLICATIONS

Valves Wellhead Equipment Safety Systems, W-K-M Division, ACF Industries, Catalog 80, 1980, 5 pages.
"Canrig Top Drive Drilling Systems," Harts Petroleum Engineer International, Feb. 1997, 2 pages.
"The Original Portable Top Drive Drilling System," TESCO Drilling Technology, 1997.
Killalea, Mike, "Portable Top Drives: What's Driving The Market?" IADC, Drilling Contractor, Sep. 1994, 4 pages.
"500 or 650 ECIS Top Drive," Advanced permanent Magnet Motor Technology, TESCO Drilling Technology, Apr. 1998, 2 pages.
"500 or 650 HCIS Top Drive," Powerful Hydraulic Compact Top Drive Drilling System, TESCO Drilling Technology, Apr. 1998, 2 pages.
"Product Information (Sections 1-10)," CANRIG Drilling Technology, Ltd. Sep. 18, 1996.
Alexander Sas-Jaworsky and J. G. Williams, Development of Composite Coiled Tubing for Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field 26536, Society of Petroleum Engineers, Inc., 1996.
G. F. Boykin, The Role of a Worldwide Drilling Organization and the Road to the Future, SPE/IADC 37630, 1997.
M. S. Fuller, M. Littler, and I. Pollock, Innovative Way to Cement a Liner Utitizing a New Inner String Liner Cementing Process, 1998.
Helio Santos, Consequences and Relevance of Drillstring Vibration on Welibore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology - A Year of Case Histories in the Drilling Environment, SPE/IADC 67770, 2001.
Mike Bullock, Tom Grant, Rick Sizemore, Chan Daigle, and Pat York, Using Expandable Solid Tubulars to Solve Well Construction Challenges In Deep Waters and Maturing Properties, IBP 27500, Brazilian Petroleum Institute - IBP, 2000.
Coiled Tubing Handbook, World Oil, Gulf Publishing Company, 1993.
Hahn, et al., "Simultaneous Drill and Case Technology - Case Histories, Status and Options for Further Development," Society of Petroleum Engineers, IADC/SPE Drilling Conference, New Orlean, LA Feb. 23-25, 2000 pp. 1-9.
M.B. Stone and J. Smith,"Expandable Tubulars and Casing Drilling are Options" Drilling Contractor, Jan./Feb. 2002, pp. 52.
M. Gelfgat,"Retractable Bits Development and Application" Transactions of the ASME, vol. 120, Jun. (1998), pp. 124-130.
"First Success with Casing-Drilling" Word Oil, Feb. (1999), p. 25.
Dean E. Gaddy, Editor, "Russia Shares Technical Know-How with U.S." Oil & Gas Journal, Mar. (1999), pp. 51-52 and 54-56.
Rotary Steerable Technology - Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells,"SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling - A Revolutionary Approach To Reducing Well Costs," SPE/IADC Paper 52789, SPE/IADC Drilling Conference, MAr. 9-11, 1999, pp. 221-229.
Silverman, "Novel Drilling Method - Casing Drilling Process Eliminates Tripping String," Petroleum Engineer International, Mar. 1999, p. 15.
Silverman, "Drilling Technology - Retractable Bit Eliminates Drill String Trips,"Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus; Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999. pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I - Casing Drilling With Directional Steering In The U.S. Gulf Of Mexico," Offshore, Jan. 2001, pp. 50-52.

Warren, et al., "Drilling Technology: Part II - Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27 - Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 01, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECp Cement Inflation And Stage Cementing Systems For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfield, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 62750, SPE/ICOTA Coiled Tubing Roundtable, Apr. 5-6, 2000, pp. 1-9.
Cales, et al., Subsidence Remediation - Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Cooiled Tubing And Hydraulic Workover Technologies Into One Integrated Drilling System, " IADC/SPE Paper 74538, IADC/SPE Drilling Conference, Feb. 26-28, 2002, pp. 1-7.
Galloway, "Rotary Drilling With Casing - A Field Proven Method Of Reducing Wellbore Construction Cost," Papaer WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WODC-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WODC-0306-05, World Oil casing Drilling Technical Conference, Mar. 6-7, 2003, pp. 1-11.
Sutriono - Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling - Casing Histories And Technology," Paper WODC-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-27.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WODC-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology - Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.

* cited by examiner

APPARATUS FOR FACILITATING THE CONNECTION OF TUBULARS USING A TOP DRIVE

CROSS REFERENCE TO RELATED APPLICATIONS

This application is a continuation of U.S. patent application Ser. No. 10/967,387, filed Oct. 18, 2004, now abandoned. U.S. patent application Ser. No. 10/967,387 is a continuation of U.S. patent application Ser. No. 09/509,073 filed Aug. 22, 2000, now abandoned. U.S. patent application Ser. No. 09/509,073 is the National Stage of International Application No. PCT G8/02203 filed Jul. 22, 1999 under 35 U.S.C. § 371. International Application No. PCT G8/02203 claims priority to GB 9815809.0 filed Jul. 22, 1998 and claims priority to GB 9818358.5 filed Aug. 24, 1998. All of the above referenced patent applications are herein incorporated by reference in their entireties.

BACKGROUND OF THE INVENTION

1. Field of the Invention

This invention relates to an apparatus for facilitating the connection of tubulars using a top drive and is more particularly, but not exclusively, intended for facilitating the connection of a section or stand of casing to a string of casing.

2. Description of the Related Art

In the construction of oil or gas wells it is usually necessary to line the borehole with a string of tubulars known as casing. Because of the length of the casing required, sections or stands of say two sections of casing are progressively added to the string as it is lowered into the well from a drilling platform. In particular, when it is desired to add a section or stand of casing the string is usually restrained from falling into the well by applying the slips of a spider located in the floor of the drilling platform. The new section or stand of casing is then moved from a rack to the well center above the spider. The threaded pin of the section or stand of casing to be connected is then located over the threaded box of the casing in the well and the connection is made up by rotation therebetween. An elevator is then connected to the top of the new section or stand and the whole casing string lifted slightly to enable the slips of the spider to be released. The whole casing string is then lowered until the top of the section is adjacent the spider whereupon the slips of the spider are re-applied, the elevator disconnected and the process repeated.

It is common practice to use a power tong to torque the connection up to a predetermined torque in order to make the connection. The power tong is located on the platform, either on rails, or hung from a derrick on a chain. However, it has recently been proposed to use a top drive for making such connection. A "top drive" is a top driven rotational system substantially used for drilling purposes, assigned to the drawworks at a higher level than the elevator, as is previously known.

Because of the high costs associated with the construction of oil and gas wells time is critical and it has been observed by the applicants that the time to connect a tubular to a top drive using existing equipment could be reduced.

SUMMARY OF THE INVENTION

Accordingly there is provided an apparatus for facilitating the connection of tubulars using a top drive, which apparatus comprises a body connectable to said top drive, said body comprising at least one gripping element radially displaceable by hydraulic or pneumatic fluid to drivingly engage a tubular to permit a screw connection between said tubular and a further tubular to be tightened to the required torque.

The present invention also provides an apparatus for facilitating the connection of tubulars using a top drive, said apparatus comprising a body connectable to said top drive, said body comprising at least one gripping element radially displaceable to drivingly engage said tubular and a sealing packer to inhibit, in use, fluid in said tubular from escaping therefrom. Preferably, said sealing packer can be actuated by hydraulic or pneumatic fluid.

One advantage of at least preferred embodiments of the invention is that the gripping elements transfer the full torque capacity of the top drive to the casing without damaging the pipe surface. Elastomeric jaws greatly reduce the marks made by the dies as compared to simple metal dies. Elastomeric jaws also enable pipes with differing inside diameters to be clamped with only one set of jaws.

The present invention also provides an apparatus for running tubulars into a borehole, said apparatus comprising a body provided with a wedge lock assembly and a hydraulically operable grapple to mechanically grip the inside wall of a tubular to be run into, or withdrawn from, the borehole, said grapple incorporating positive locking means to prevent inadvertent release of said grapple, said body further comprising means to prevent spillage of drilling fluid when the body is withdrawn from the tubular, a sealing packer for engagement with the tubular to permit fluid to be circulated within the tubular, and a stabbing guide.

In use, such an apparatus may be connected to a top-drive unit via a threaded connection, or to a Kelly driven rig via a pump joint latched into an elevator. Both systems have available a means of connecting up to a circulating system that will permit the casing to be filled or circulated at any time during the running operation.

Casing is normally run by picking up a joint at a time, utilizing single pickup elevators to bring the joint into the derrick and connect it to the previously run joint, whether it be by threaded connection or "mechanical latching or locking". The two joints are either screwed or locked together and then lowered into the well bore using elevators.

With heavy casing strings it is required that very large elevators are used to be able to handle the load. This often means that the top of the casing joint must be set 8–10 feet above the rig floor to permit disengagement to take place. Scaffolding is often required for the rig crews to be able to stab or connect the next joint to the string. It is also normal to either utilize a separate pack-off assembly, or a fillup hose that must be installed by the rig crew after it has been lowered and set in the slips.

Preferred embodiments of the present invention will permit the casing to be picked up by single pickup elevators, connected either by rotation or mechanical latch, and then the casing running tool to be "stabbed" into the bore of the top joint without damage, due to the rubber bull-nose guide 216. When the tool is at the correct depth of penetration within the casing bore, the hydraulic piston is actuated to drive the grapple down onto the wedge lock and secure the grapple to the casing wall. As the casing string is lifted, the wedge-lock continues to drive into the grapple bore, providing an ever increasing wedge lock. The compression spring installed within the hydraulic piston provides a "positive-lock" or failsafe should the hydraulic system fail for any reason.

When the apparatus is engaged, it is then possible to push, pull, or even rotate the casing string. A seal ring assembly is required to rotate the casing string to permit constant control of the hydraulic actuating piston to be maintained.

Preferred embodiments of the apparatus are equipped with a through-bore to permit casing fillup and circulation to take place at any time. There may also be provided a pack-off that can be either inflatable or flow pressure operated.

The present invention also provides a top drive having an apparatus in accordance with the present invention attached thereto.

BRIEF DESCRIPTION OF THE DRAWINGS

Some preferred embodiments of the invention will now be described by way of example only, with reference to the accompanying drawings, in which.

DETAILED DESCRIPTION OF THE PREFERRED EMBODIMENT

Figure 1:
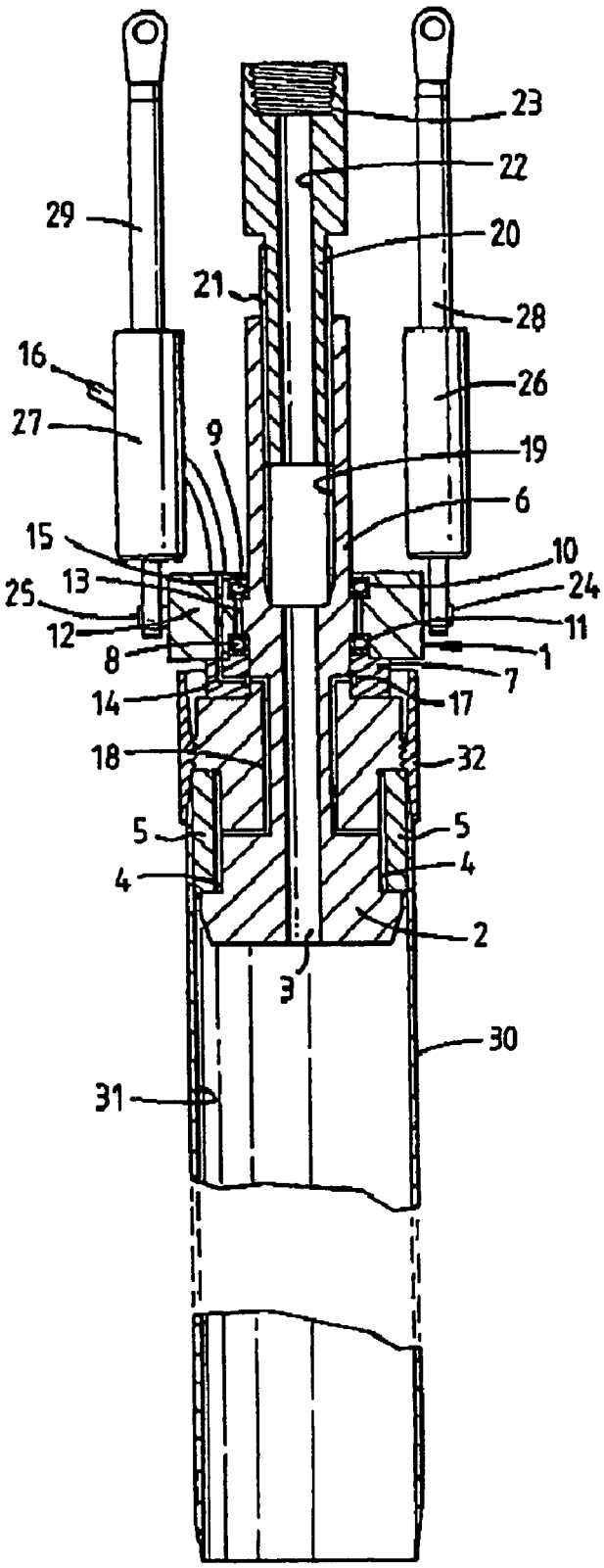
FIG. 1 is a cross-sectional side view of a first embodiment of an apparatus in accordance with the present invention inserted in a section of casing.

Referring to FIG. 1 there is shown an apparatus which is generally identified by reference numeral 1. The apparatus 1 comprises a cylindrical body 2 which has a central passage 3 therethrough. The cylindrical body 2 has circumferentially spaced recesses 4 thereabout in which respective gripping elements 5 are located.

The upper part 6 of the cylindrical body 2 is of a reduced outer diameter. The upper part 6 passes through a rotary transmission 7 and is rotatably supported by two bearings 8, 9 which are arranged in corresponding channels 10, 11 in an annular support 12. A circumferentially raised portion 13 between the two bearings 8, 9 is provided in the upper part 6 to inhibit longitudinal movement of the cylindrical body 2.

The rotary transmission 7 is mounted fast on the annular support 12 and is in sealing tight relation with the upper part 6 which is rotatable relative thereto. The rotary transmission 7 is provided with a feed passage 15 in the annular support 12 and with a feed line 16. One end of a feed passage 14 is in fluid communication with the feed passage 15 and the other end of the feed passage 14 is in fluid communication with a radial channel 17. Feed passages 18 are provided in the cylindrical body 2 to link the radial channel 17 with the circumferential recesses 4 behind each gripping element.

The upper part 6 is provided with internal splines 19 along the upper part of the passage 3. The lower end of a connecting member 20 is provided with corresponding external splines and is located in the upper part of the passage 3. The upper end of the connecting member 20 is provided with a circulating canal 22 and threads 23 for connection to a top drive (FIG. 2).

Figure 2:
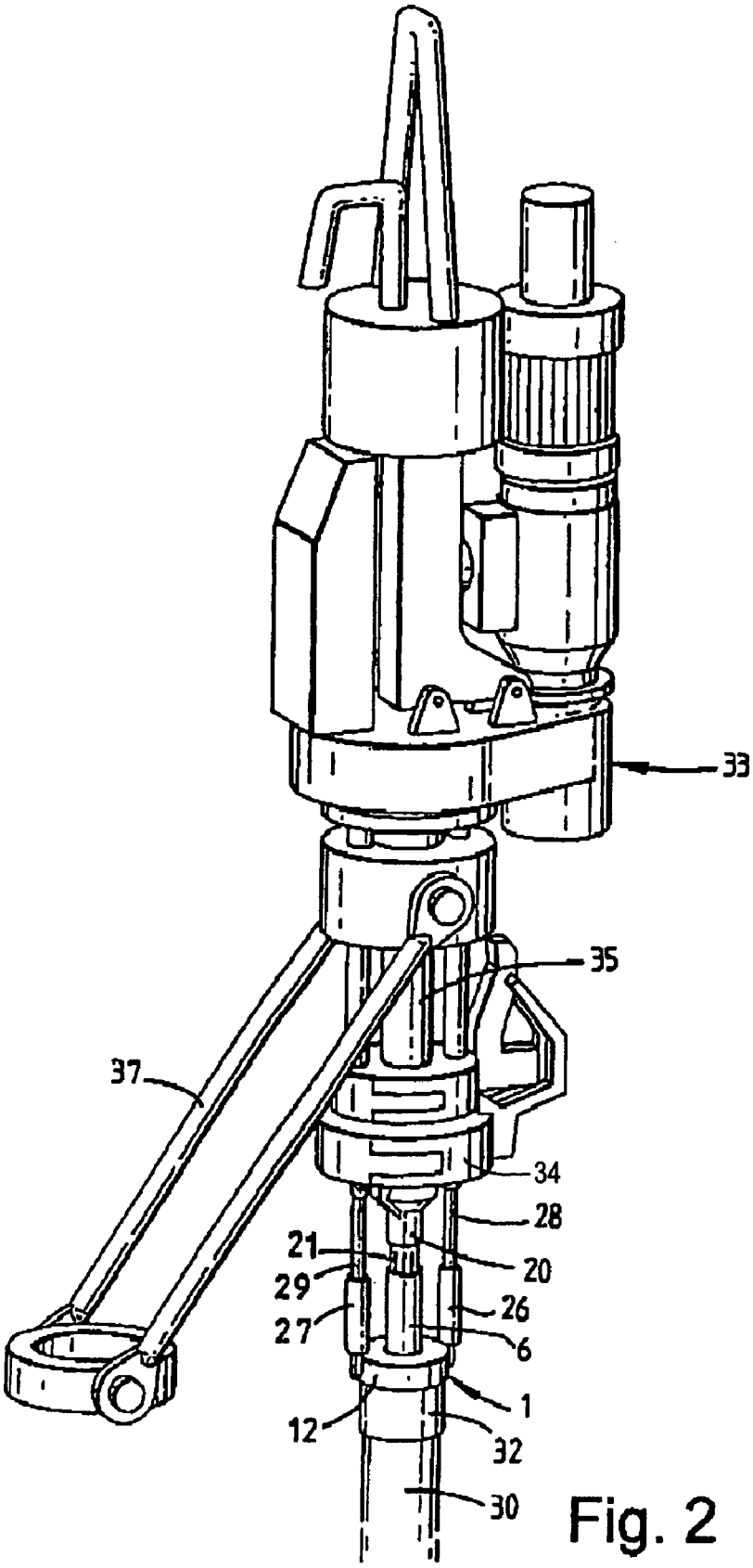
FIG. 2 shows the apparatus of FIG. 1 connected to a top drive and inserted in a section of casing.

The support member 12 is provided with two axles 24, 25 to which compensating cylinders 26, 27 are attached, the corresponding pistons 28, 29 being, in use, connected to the body of the top drive (FIG. 2).

Gripping elements 5 are preferably based on the construction described in PCT Publication No. WO 94/05894 which is incorporated herein for all purposes, and sold by the applicants under the trade mark "MICRO-GRIP".

The gripping elements 5 comprise a plurality of longitudinally extending strips (not shown) which are embedded side by side in an elastomeric base member (not shown). Each strip projects out from said elastomeric base member, and each strip has a pipe gripping edge (not shown) facing away from the elastomeric base member, so that channels are formed between adjacent strips to accommodate debris from the surface of the casing to be gripped. The pipe gripping edge may, for example, comprise teeth, so that the strips resemble saw blades, or may comprise particulate material bonded to the strips. This type of gripping element allows rotational torque to be applied to the tubular and longitudinal forces produced by circulating fluid within the tubular and the weight of the tubular to be taken.

The cylindrical body 2 is shown in FIG. 1 in a section of casing 30 with gripping elements 5 in a radially extended position, engaging the inner wall 31 of the section of casing 30 beneath a threaded box 32.

In use, the pistons 28, 29 are connected to the stator 34 of the top drive 33 (FIG. 2). The rotor 35 of the top drive 33 is connected to the connecting member 20. The section of casing 30 is positioned over the upper portion of a casing string using, for example, a pipe positioning device. The top drive 33 with the attached apparatus 1 is lowered so that the cylindrical body 2 thereof enters the casing 30. Alternatively, the section or stand of casing may be brought towards the apparatus 1 using the methods and apparatus disclosed in co-pending UK Patent Application No. 9818366.8 entitled "Methods and Apparatus for Facilitating the Connection of Tubulars Using a Top Drive" filed by the applicant for the present application on 24 Aug. 1998. If the support member 12 hits the top of the threaded box 32, the compensating cylinders 26, 27, which contain compressed air, cushion the impact whilst the splines 19, 21 in the upper part 6 of the cylindrical body 2 will allow relative longitudinal movement between the apparatus 1 and the top drive 33 whilst being able to transmit rotation therebetween.

Hydraulic pressure is applied through feed line 16, feed passage 15, feed passage 14, radial channel 17, and feed passage 18 into recess 4 behind gripping elements 5, forcing the gripping elements 5 radially outwardly to engage the inner wall 31 of the casing 30.

The top drive 33 may now be used to rotate the rotor 35 which in turn rotates the connecting member 20, the cylindrical body 2 and hence the casing 30. The compensating cylinders 26, 27 will allow a small downward movement as the threaded pin on the bottom of the casing enters the box on the top of the string, and may be controlled remotely. The compensating cylinders 26, 27 may be of the pneumatic compensating type, i.e. their internal pressure may be adjusted to compensate for the weight of the casing 30 so that movement of the tubular may be conducted with minimal force. Pneumatic compensating cylinders also reduce the risk of damage to the threads of the tubulars. This can conveniently be achieved by introducing pneumatic fluid into the cylinders 26, 27 and adjusting the pressure therein. Hydraulic cylinders may, however, be used or hydraulic cylinders provided with a pneumatic bellows system.

Once the joint is correctly tightened the elevator 37 is swung into position and the elevator slips therein (not shown) are actuated to grip the casing 30 beneath the box 32.

The top drive 33 is then raised a small amount using the drawworks to enable the slips in the spider to be released and the top drive and casing string is then lowered.

As the casing is lowered liquid may be introduced into the casing 30 via the connecting canal 22 and the central passage 3. The introduction of such liquid is often desirable to facilitate the lowering of the casing.

Figure 3:
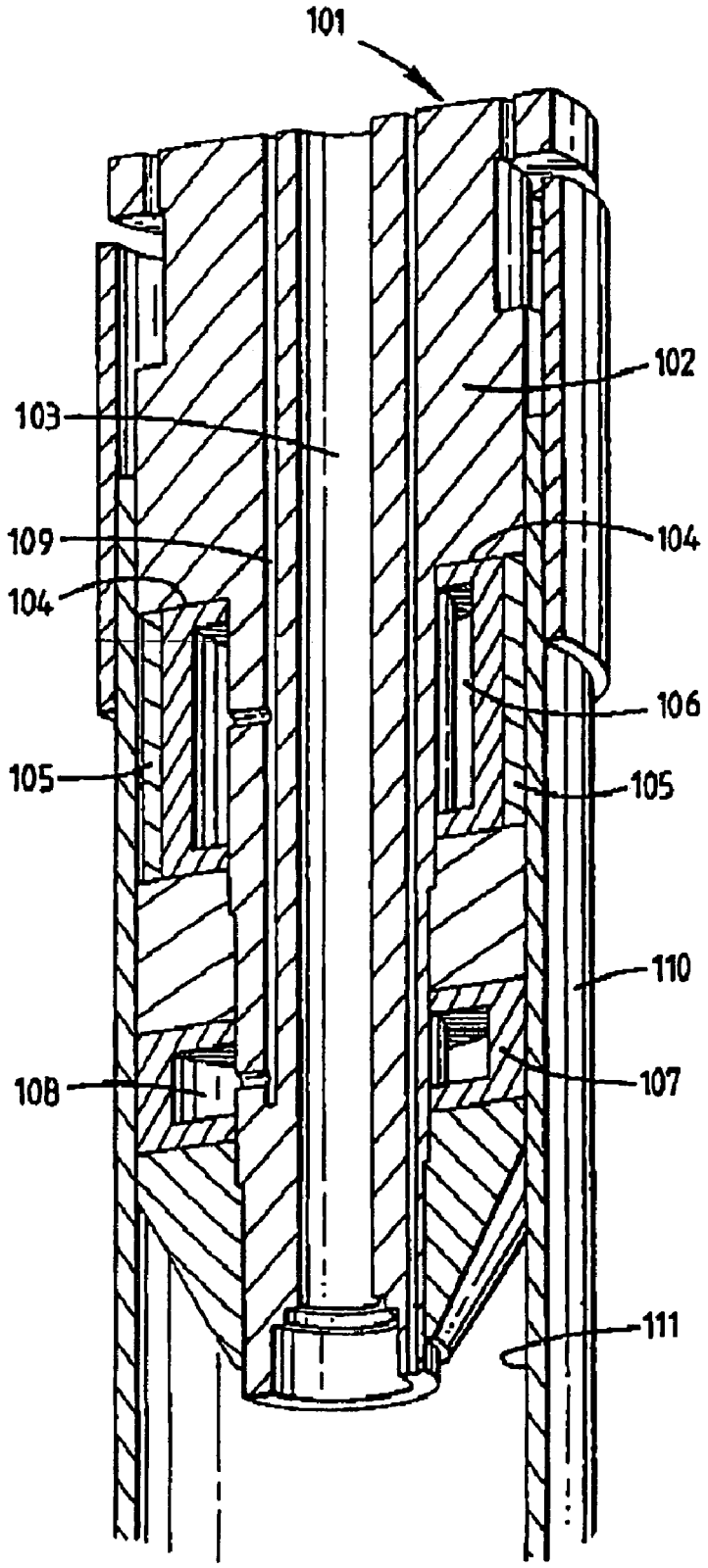
FIG. 3 shows a cross-sectional side view in perspective of part of a second embodiment of an apparatus in accordance with the present invention.

Referring to FIG. 3 there is shown an apparatus in accordance with a second embodiment of the present invention which is generally identified by the reference numeral 101.

The apparatus 101 is generally similar to that of FIG. 1, in that it comprises a cylindrical body 102 which has a central passage 103 therethrough. The cylindrical body 102 has recesses 104 thereabout in which gripping elements 105 are located. The gripping elements 105 are provided with recesses 106.

The cylindrical body 102 is also provided with a cylindrical sealing packer 107 arranged below the gripping elements 105. The cylindrical sealing packer 107 is provided with a recess 108. The cylindrical sealing packer 107 which is made from an elastomeric material is fast with the cylindrical body 102.

The cylindrical body 102 is provided with a feed passage 109 which is at the upper end connected to a hydraulic fluid supply, and at the other, to the recesses 106 and 108 in the gripping elements 105 and the cylindrical sealing packer 107 respectively.

In use, the apparatus 101 is connected to a top drive, such as that shown in FIG. 2, and is inserted into the top of a section or stand of casing 110. Hydraulic fluid pressure is applied through feed passage 109 into recesses 106 and 108 which moves the gripping elements 105 into engagement with the inner wall 111 and the cylindrical sealing packer 107 into contact with the inner wall 111. The gripping elements 105 engage with the inner wall 111 of the casing 110 so that rotational force can be transmitted from the apparatus 101 to the casing 110. The sealing packer 107 substantially prevents any fluids such as mud from escaping between the apparatus 101 end the casing 110. This is particularly advantageous where it is desired to circulate fluid to facilitate running the casing. In particular, if the casing string becomes lodged on an obstruction, liquid can be pumped down the casing string under high pressure to remove the obstruction. The sealing packer 107 facilitates this operation by inhibiting liquid under high pressure escaping through the top of the casing 30.

Figure 4:
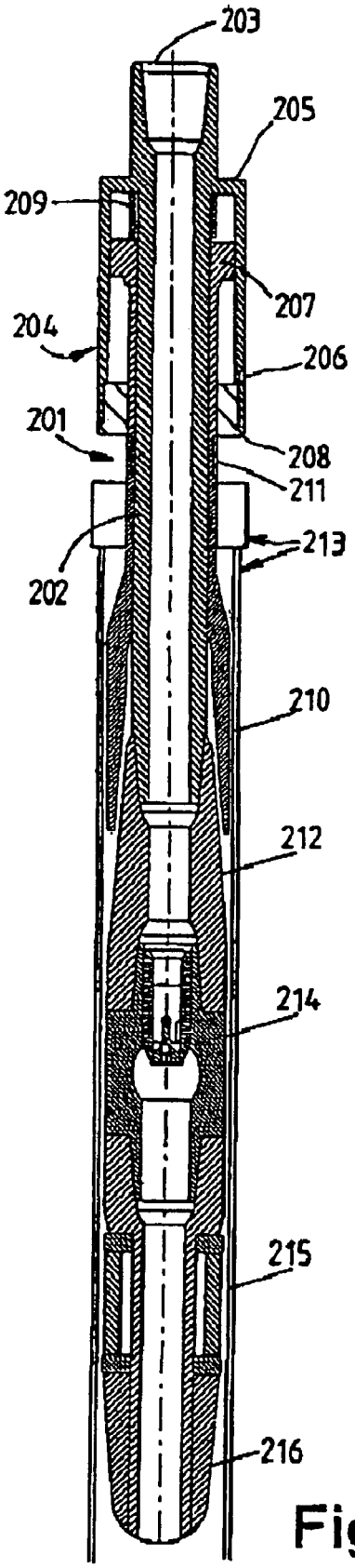
FIG. 4 shows a cross-sectional side view of a third embodiment of an apparatus in accordance with the present invention.
Figure 5:
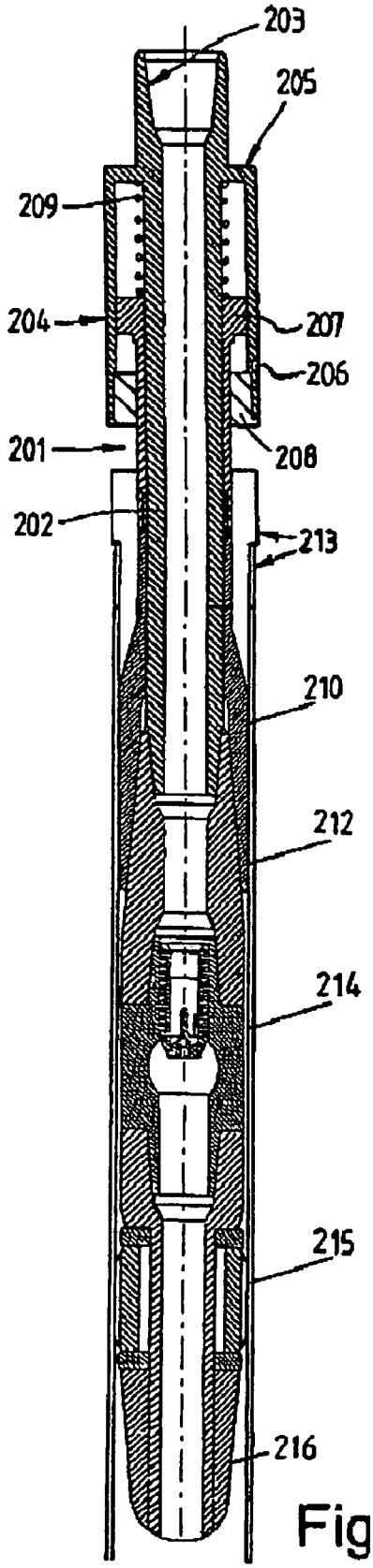
FIG. 5 shows a cross-sectional side view of the embodiment of FIG. 4 in use.

Referring to FIGS. 4 and 5 there is shown an apparatus in accordance with a third embodiment of the present invention which is generally identified by the reference numeral 201.

The apparatus comprises a cylindrical body 202 with a threaded connection 203 at the upper end for connection to a top drive. Attached to the cylindrical body 202, or machined into it, is a hydraulic cylinder 204, with threaded ports 205, 206 at opposite ends. These ports 205 and 206 permit hydraulic fluid to be injected under pressure to manipulate a hydraulic piston 207, secured within the cylinder by a threaded lock ring 208. A compression spring 209 is located in the cylinder 204 above the piston 207.

A grapple 210, provided with serrated teeth machined into its outer surface, is provided around the cylindrical body 202 below the hydraulic cylinder 204. The grapple 210 is connected to the hydraulic piston 207 by a threaded connection 211. A corresponding wedge lock 212 is provided on the cylindrical body 202. The grapple 210 and corresponding wedge lock 212 are located, in use, inside a casing 213. The piston 207 and lock ring 208 are fitted with seal rings (not shown) to prevent hydraulic fluid leakage.

A mud-check valve 214 is connected by a threaded connection at the lower end of the wedge lock 212. Below this valve is a rubber pack-off assembly 215. These prevent spillage of drilling fluid when the apparatus 201 is removed from within the casing joint 213. The pack-off 215 can be energized by either internal mud pressure or external mud flow.

In use, the apparatus 201 is lowered into the casing joint 213 as shown in FIG. 4. The grapple 210 is held out of contact with the wedge lock 212 by hydraulic fluid injected into port 206.

When the apparatus 201 is located at the correct installation depth within the casing 213, the pressure and fluid is released from port 206, and fluid is injected into port 205. This pushes the piston 207 downwards, pressing the grapple 210 against the wedge lock 212. The grapple 210 is forced outwards by the wedge lock 212, forming a mechanical friction grip against the inner wall of the casing 213. This is shown in FIG. 5.

The rig lifting equipment (not shown) raises the apparatus 201, and this causes the wedge lock 212 to be pulled upwards against the inner surface of the grapple 210, ensuring that constant outward pressure is applied to the grapple 210. The grip becomes tighter with increasing pull exerted by the rig lifting equipment.

Should hydraulic pressure be lost from port 205, the compression spring 209 ensures that the piston 207 continues to press the grapple 210 against the wedge lock 212, preventing release of the grapple from the wedge lock.

The apparatus 201 and casing 213 are then lowered into the well bore and the casing is secured. The apparatus 201 is lowered so that it supports its own weight only, and hydraulic fluid is then pumped out of port 205 and into port 206 to release the grapple 210 from the wedge lock 212 and thus release the apparatus 201 from the casing 213. The apparatus is then removed from the casing joint 213 and the process is repeated.

It is envisaged that the apparatus as described above could be used in conjunction with any of the apparatus and used with any of the methods as described in the co-pending International Applications based on GB Application Nos. 9818360.1, 9818363.5 and 9818366.8 entitled "An Apparatus for Facilitating the Connection of Tubular Using a Top Drive", "Method and Apparatus for Facilitating the Connection of Tubulars using a Top Drive" and "Method and Apparatus for facilitating the Connection of Tubulars using a Top Drive" respectively.

The invention claimed is:

1. An apparatus for connecting a first tubular to a second tubular using a top drive, comprising:

a body connectable to the top drive;

a plurality of rigid gripping pistons radially displaceable by hydraulic or pneumatic fluid directly applied to an inner surface of each gripping piston to drivingly engage the first tubular to permit a screw connection between the first tubular and the second tubular to be tightened to a required torque, the plurality of gripping pistons disposed within the body in substantially the same axial plane with one another; and a sealing packer to inhibit, in use, fluid in the first tubular from escaping therefrom.

2. The apparatus as claimed in claim 1, wherein said sealing packer is actuated by hydraulic or pneumatic fluid.

3. An apparatus for connecting a first tubular to a second tubular, comprising:

a top drive;

a body connectable to the top drive; and at least one recess disposed within an outer surface of the body, wherein the at least one recess houses at least one gripping element, wherein the at least one gripping element is at least one piston radially displaceable outward from the at least one recess by fluid applied to an inner surface thereof to engage the first tubular.

4. The apparatus of claim 3, wherein the at least one gripping element transfers rotational torque from the top drive to permit a screw connection between the first tubular and the second tubular.

5. The apparatus of claim 4, wherein the screw connection is tightened to a prescribed moment.

6. An apparatus for connecting a first tubular to a second tubular, comprising;

a top drive;

a body having a first section and a second section;

a plurality of recesses disposed within an outer diameter of the second section and disposed in substantially the same axial plane with one another; and a rigid gripping element disposed within each recess, wherein each gripping element is a piston radially extendable from its respective recess with pressurized hydraulic or pneumatic fluid directly applied to its inner surface.

7. The apparatus of claim 6, wherein the first section comprises a splined recess into which a splined connecting member may be located.

8. The apparatus of claim 6, wherein the gripping elements are radially extendable to engage an inner surface of the first tubular.

9. The apparatus of claim 6, further comprising one or more compensating pistons, wherein the compensating pistons are pneumatically operable and adjustable to compensate for different weights of the first tubular.

10. The apparatus of claim 8, wherein the body is connected to the top drive.

11. The apparatus of claim 10, wherein the top drive provides rotational torque to permit a screw connection between the first tubular and the second tubular.

12. An apparatus for connecting a first tubular to a second tubular using a top drive, comprising:

a body connectable to the top drive;

a plurality of rigid pistons disposed in substantially the same axial plane and radially displaceable from a plurality of recesses within the body by pressurized fluid directly applied to an inner surface thereof, the plurality of pistons gripping the first tubular torsionally to tighten a screw connection between the first and second tubulars and gripping the first tubular axially to carry the weight of the first tubular; and a sealing packer to prohibit pressurized fluid in the first tubular from escaping therefrom.

13. The apparatus of claim 12, further comprising one or more compensating pistons, wherein the compensating pistons are pneumatically operable and adjustable to compensate for different weights of the first tubular.

14. An apparatus for connecting a first tubular to a second tubular using a top drive, comprising:

a body connectable to said top drive;

a plurality of rigid, fluid-actuated pistons disposed within a plurality of recesses within an outer surface of the body in substantially the same axial plane with one another;

a fluid communication path for delivering fluid pressure directly to inner surfaces of the plurality of fluid-actuated pistons, the fluid pressure radially displacing the plurality of fluid-actuated pistons to grip an inner surface of the first tubular; and a sealing packer to prohibit pressurized fluid in the first tubular from escaping therefrom.

15. The apparatus of claim 14, further comprising one or more compensating pistons, wherein the compensating pistons are pneumatically operable and adjustable to compensate for different weights of the first tubular.

16. The apparatus of claim 1, wherein the plurality of gripping pistons are circumferentially spaced from one another in substantially the same axial plane.

17. The apparatus of claim 3, further comprising a sealing packer disposed within the outer surface of the body to inhibit fluid in the first tubular from escaping therefrom.

18. The apparatus of claim 14, wherein the sealing packer is disposed within a second recess within the outer surface of the body and radially extendable from the second recess to contact the inner surface of the first tubular.

19. A method for manipulating a first tubular to connect to a second tubular, comprising:

providing a gripping apparatus comprising:

a body having at least one recess therein, and at least one gripping piston disposed within the at least one recess;

radially displacing the at least one gripping piston to grippingly engage an inner surface of the first tubular by introducing pressurized fluid behind the at least one gripping piston; and rotating the first tubular with a top drive connected to the body.

20. The method of claim 19, further comprising introducing fluid through the first tubular while lowering the first tubular.

21. The method of claim 20, wherein the first tubular is sealingly engaged by a sealing packer disposed on the body.

22. The method of claim 21, wherein the sealing packer provides a sealed fluid path through the apparatus and the first tubular.

23. An apparatus for connecting a first tubular to a second tubular using a top drive, comprising:

a body connectable to the top drive;

a plurality of rigid gripping elements disposed within a plurality of recesses within an outer surface of the body in substantially the same axial plane with one another;

a sealing packer to prohibit pressurized fluid in the first tubular from escaping therefrom; and a fluid communication path for delivering fluid pressure directly to inner surfaces of the plurality of gripping elements, the fluid pressure radially displacing the plurality of gripping elements to grip an inner surface of the first tubular, wherein the fluid communication path is further capable of delivering fluid pressure directly to the sealing packer to radially displace the sealing packer into contact with the inner surface of the first tubular.

24. An apparatus for connecting a first tubular to a second tubular using a top drive, comprising:

a body connectable to the top drive;

a plurality of rigid gripping elements disposed within a plurality of recesses within an outer surface of the body in substantially the same axial plane with one another;

a sealing packer to prohibit pressurized fluid in the first tubular from escaping therefrom, the sealing packer disposed within a second recess within the outer surface of the body and radially extendable from the recess to contact an inner surface of the first tubular; and a fluid communication path for delivering fluid pressure directly to inner surfaces of the plurality of gripping elements, the fluid pressure radially displacing the plurality of gripping elements to grip the inner surface of the first tubular and the fluid pressure further deliverable directly from the fluid communication path to the sealing packer.

25. The method of claim 19, wherein the at least one recess comprises a plurality of recesses circumferentially spaced within the body and the at least one gripping piston comprises a plurality of gripping pistons, each of the plurality of gripping pistons disposed within each of the plurality of recesses.

26. The method of claim 25, wherein the plurality of recesses are circumferentially spaced around the body in substantially the same axial plane.

27. The method of claim 25, wherein radially displacing the plurality of gripping pistons to grippingly engage the inner surface of the first tubular is accomplished by introducing pressurized fluid directly behind the plurality of gripping pistons.

28. The method of claim 19, wherein radially displacing the at least one gripping piston to grippingly engage the inner surface of the first tubular by introducing pressurized fluid behind the at least one gripping piston comprises extending the at least one gripping piston radially outward in a line substantially perpendicular to a longitudinal axis of the body.

29. The apparatus of claim 3, wherein the at least one recess comprises a plurality of recesses and the at least one gripping element comprises a plurality of gripping elements, each of the plurality of recesses housing each of the plurality of gripping elements.

30. The apparatus of claim 3, wherein the fluid is directly applied to the inner surface.

31. The apparatus of claim 3, wherein the at least one recess acts as a cylinder from which the at least one gripping element is displaced radially outward.

32. The apparatus of claim 3, wherein the at least one gripping element is displaceable radially outward substantially perpendicular to a longitudinal axis of the body.

* * * * *